US008511125B2

(12) United States Patent
Reimer et al.

(10) Patent No.: US 8,511,125 B2
(45) Date of Patent: Aug. 20, 2013

(54) FLEXIBLE NECKING STATION ARRANGEMENT FOR LARGER BEVERAGE CANS

(75) Inventors: David Reimer, Elgin, IL (US); Leo F. Hayden, Fox River Grove, IL (US)

(73) Assignee: Rexam Beverage Can Company, Chicago, IL (US)

( * ) Notice: Subject to any disclaimer, the term of this patent is extended or adjusted under 35 U.S.C. 154(b) by 1355 days.

(21) Appl. No.: 11/809,476

(22) Filed: May 31, 2007

(65) Prior Publication Data

US 2008/0295558 A1 Dec. 4, 2008

(51) Int. Cl.
*B21D 51/26* (2006.01)
*B21D 22/00* (2006.01)

(52) U.S. Cl.
USPC ..... 72/94; 72/348; 72/353.4

(58) Field of Classification Search
USPC ..... 72/68, 84, 94, 117, 348, 349, 353.4, 72/355.4, 379.4, 120, 121, 124, 125, 126
See application file for complete search history.

(56) References Cited

U.S. PATENT DOCUMENTS

| | | | | |
|---|---|---|---|---|
| 3,735,629 | A | 5/1973 | Paramonoff | 72/349 |
| 4,414,836 | A | 11/1983 | Saunders | 72/349 |
| 4,563,887 | A | 1/1986 | Bressan et al. | 72/84 |
| 4,774,839 | A | 10/1988 | Caleffi et al. | 72/355.4 |
| 4,781,047 | A | 11/1988 | Bressan et al. | 72/84 |
| 4,852,377 | A | 8/1989 | Mikas et al. | 72/349 |
| 5,014,536 | A | 5/1991 | Saunders | 72/349 |
| 5,138,858 | A | 8/1992 | Johnson et al. | 72/68 |
| 5,282,375 | A | 2/1994 | Lee, Jr. et al. | 72/4 |
| 5,394,727 | A | 3/1995 | Diekhoff et al. | 72/348 |
| 5,497,900 | A | 3/1996 | Caleffi et al. | 220/656 |
| 5,634,364 | A | 6/1997 | Gardner et al. | 72/56 |
| 5,687,599 | A | 11/1997 | Donaldson et al. | 72/62 |
| 5,704,240 | A * | 1/1998 | Jordan | 72/103 |
| 5,775,161 | A | 7/1998 | Caleffi et al. | 72/356 |

(Continued)

FOREIGN PATENT DOCUMENTS

| | | |
|---|---|---|
| WO | WO 88/05700 | 8/1988 |
| WO | WO 96/16754 | 6/1996 |
| WO | WO 2006/095215 | 9/2006 |

OTHER PUBLICATIONS

International Preliminary Report on Patentability mailed May 11, 2009 in PCT/US2008/004653, filed Apr. 9, 2008.

*Primary Examiner* — Teresa M Ekiert
(74) *Attorney, Agent, or Firm* — McDonnell Boehnen Hulbert & Berghoff LLP

(57) ABSTRACT

Beverage can manufacturing apparatus is provided in the form of a set of N necking stations $S_1, S_2 \ldots S_N$ for progressively necking a beverage can body having a diameter greater than or equal to 2.8 inches to result in an open end designed to receive a first standard end. The necking stations are constructed such that a subset of the necking stations $S_i \ldots S_j$, where $1 \leqq i < j < N$, progressively neck the beverage can body to result in an open end designed to receive a second standard end for the beverage can. The diameter of the first standard end is less than the diameter of the second standard end. For example, the first standard end is say a 202 standard end and the second standard end is a 209, 204, or a 206 standard end. Alternatively, for example, the first standard end could be a 206 end and the second standard end could be a 209 standard end.

6 Claims, 6 Drawing Sheets

(56) References Cited

U.S. PATENT DOCUMENTS

| | | | | |
|---|---|---|---|---|
| 6,032,502 | A | 3/2000 | Halasz et al. | 72/117 |
| 6,434,996 | B1 | 8/2002 | Aschberger et al. | 72/348 |
| 6,484,550 | B2 | 11/2002 | Halasz et al. | 72/353.4 |
| 6,698,265 | B1 | 3/2004 | Thomas | 72/94 |
| 7,000,797 | B2 | 2/2006 | Forrest et al. | 220/269 |

* cited by examiner

FLEXIBLE NECKING STATION ARRANGEMENT FOR LARGER BEVERAGE CANS

BACKGROUND

A. Field

The invention relates to apparatus used in the die necking of aluminum beverage cans. More particularly, this invention relates to a flexible arrangement of necking stations for necking the open end of a can body, in which the can body has a diameter greater than 2.8 inches. Such cans are used for holding larger volumes of beverage such as for example 20 or 24 fluid ounces.

B. Related Art

Conventional aluminum beverage cans are made from an aluminum alloy disc which is drawn into a cup and then subject to further drawing and ironing into a can body by a device known as a can body maker. The can body has a sidewall, composed of a mid-wall portion and a top wall portion, and an integral bottom wall. In the drawing and ironing process, the bottom of the can is typically formed into a central inwardly-directed dome configuration and a peripheral, lowermost annular rim (sometimes referred to as a "stand" or "nose radius") which forms the structure supporting the can when the can is placed upright on a horizontal surface. Can body makers, including punch sleeves and related tooling for forming a can body are known in the art and commercially available, see for example U.S. Pat. No. 6,434,996, the content of which is incorporated by reference herein. See also U.S. Pat. Nos. 4,852,377; 3,735,629; 5,394,727; 5,014,536 and 4,414,836, also incorporated by reference herein.

The can thus formed is then sent to a necking unit having a plurality of stations in which the top wall is subject to a plurality of necking steps, in which the diameter of the open end of the can is progressively reduced. After necking, a flange is formed on the open end for receiving a separate closure member or end.

Necking units use a multitude of individual, progressive necking stations, each one progressively reducing the diameter of the neck a bit more than the diameter produced from the previous necking station. Necking units are commercially available and described in the patent literature, see for example U.S. Pat. Nos. 5,775,161; 4,774,839; 5,775,130 and 6,698,265. The description of the necking units and individual necking modules (stations) of these patents is incorporated by reference herein.

This disclosure relates to a set of necking stations used to neck a relatively large size diameter beverage can (one with a diameter prior to necking of at least 2.8 inches, such as for example 3.0 inches or larger) in which the set of necking stations can be used to neck the can down to a first diameter for receiving a first standard end such as a 202 (2 and 2/16ths inches) end, and in which a subset of the necking stations can be used to neck the can down to receive a second standard diameter end such as a 206 (2 and 6/16ths inches) end or a 209 (2 and 9/16ths) diameter end. This feature provides the flexibility of the can manufacturer to change the necking of the can body to adapt to different end requirements for its customers, without having to invest in creation of separate tooling. For example, where customer A desires to use the larger size can and have a small end (e.g., 202 end), a subset of the necking stations created for manufacturing such an end can also be used if the customer (or a different customer, customer B) wants to use the same basic large size can but have a larger end (e.g., a 209 end). This invention also relates to a punch sleeve for a can body maker which is modified to provide a longer top wall in order to allow such a larger diameter can to be necked to smaller diameter sizes.

SUMMARY

In a first aspect, a beverage can manufacturing apparatus is provided in the form of a set of N necking stations $S_1, S_2 \ldots S_N$ for progressively necking a beverage can body having a diameter greater than or equal to 2.8 inches to result in an open end designed to receive a first standard end. The necking stations are constructed such that a subset of the necking stations $S_i \ldots S_j$, where $1 \leqq i < j < N$, progressively neck the beverage can body to result in an open end designed to receive a second standard end for the beverage can. The diameter of the first standard end is less than the diameter of the second standard end. For example, the first standard end is say a 202 standard end and the second standard end is a 209, 204, or a 206 standard end. Alternatively, for example, the first standard end could be a 206 end and the second standard end could be a 209 standard end.

Consider, for example, a set of twenty necking station, S1, S2, . . . S20. Here, in this example N is equal to twenty. The twenty necking stations are used to neck a 3 inch diameter can down to receive a 202 end for customer A. However, a subset of the stations can be used to neck the can body to fit a 209 standard end, for example in the situation where customer B wants to use the same base large diameter can body but with a larger diameter end such as a 209 diameter end. The change to neck the can body down to a new diameter for customer B does not require manufacture of any new necking stations, even though the end diameter is different, since the necking stations were designed in the first place to allow for this possibility. Thus, a subset of the 20 necking stations can be selected and used to make the can body fit a 209 diameter end. The subset of stations to use for the 209 diameter end could be, for example stations, S1 to S10. In this case, i=1 and j=10. Alternatively, for example where Customer B wants a 206 end, the subset of stations which is selected could be some other subset of 20 necking stations, such as stations S1, S2, . . . S15, where i=1 and j=15. The subset of stations need not necessarily be consecutive stations in the original set of N stations. However, in some embodiments, they may be consecutive, such as S1, S2 . . . S10, or S5, S6, . . . S15.

In one arrangement, the stations are consecutive stations $S_i$, $S_{i+1} \ldots S_j$ in the set S1 to SN, and the diameter reduction D achieved for each of the necking stations $S_i$, $S_{i+1} \ldots S_j$ is defined approximately in accordance with the following relationship:

$$D=T/N$$

where T represents the total amount of necking to be performed on the beverage can by the set of N necking stations and N represents the number of necking stations, and wherein the diameter reduction D for at least one of the necking stations in the series of necking stations $S_i, S_{i+1}, \ldots, S_j$ is adjusted from D by an amount $\pm\Delta$, where $\Delta$ is some small variation from the diameter reduction D.

In one configuration, the subset of stations used to neck down to a second standard diameter end is basically selected roughly in the middle of the sequence of stations from S1 to SN. More precisely, the "middle" station in the subset of stations is represented by $S_{(i+j)/2}$, and this station is within 2 necking stations of the middle necking station or stations in the progression of necking stations $S_1, S_2, \ldots, S_N$. For example, if N is equal to 20, i=5 and j=15, and the subset consists of stations S5 to S15. The middle station is S10 (i+j divided by 2), and the middle station S10 is also the middle station in the sequence from S1 to S20. In this situation, the tooling from the S1 station is moved and installed in the 5th operation station, S2 is moved to the $6^{th}$ operation station, etc. Either no tooling is present in the $1^{st}$ to $4^{th}$ stations or if tooling is present it is rendered inoperative, by keeping it in the "up" or idle position.

In one embodiment, the beverage can comprises a can designed to hold at least 12 oz. of beverage, such as 20 oz. of beverage. In one specific embodiment, the beverage can comprises a 24 oz. beverage can.

The number of necking stations N can vary. In one embodiment, N is greater than or equal to 20. In one specific example, N is equal to 20 and wherein $S_t$ comprises either the $4^{th}$, $5^{th}$ or $6^{th}$ necking station.

The concept of flexibility of the design of the necking stations can be extended further such that one subset allows the can to be necked down to a second diameter standard end and a third subset allows the can to be necked down to a third diameter standard end. In particular, a necking station $S_k$ is present in the set of necking stations as follows: $S_1, S_2, \ldots S_j, S_{j+1}, \ldots S_k, S_{k+1} \ldots S_N$, and wherein a second subset of the necking stations including station $S_k$ results in a set of necking stations which progressively neck the beverage can body to result in an open end designed to receive a third standard end for the beverage can body, the third standard end having a smaller diameter than the second standard end. Consider for example a set of 25 necking stations (N=25) for necking down a can body of at least 2.8 inch diameter to a 202 end. S1-S10 neck down to a 209 end (j=10). S1-S20 neck down to a 206 end. K is 20 in this example.

In another aspect of this invention, a can body maker includes a punch sleeve which is modified in order to produce a sufficient top wall length in the can body such that the required amount of necking from the larger diameter body to a relatively small diameter end, such as 209, 202 or 204 can be performed without wrinkling or other problems in the can body. In one particular embodiment, the punch sleeve is designed such the body maker produces a beverage can body having a topwall length of at least 1.00 inches, such as between 1.00 and 1.40 inches. In one particular embodiment, beverage can manufacturing apparatus is provided including a set of necking stations which provides the flexibility as described above, and also a can body maker for forming the beverage can body having a punch sleeve and wherein the punch sleeve is designed such that the beverage can body has a topwall length of at least about 1.00 inch.

In another particular configuration, the can body maker is used in conjunction with the flexible set of necking stations for larger diameter can bodies, N is at least about 20 and wherein the diameter reduction performed by the N necking stations is approximately between 13/16 inches and 1.40 inches, inclusive. In another particular embodiment, the beverage can is designed to hold at least 20 oz. of beverage, the set of necking stations $S_1 \ldots S_N$ neck the beverage can body down to a receive a 202 standard end and wherein the subset of stations necks the can down to receive a 209, 206, or a 204 standard end.

Other aspects of the invention include a beverage can made in accordance with the apparatus of this disclosure. Such as a can made from the stations S1 to SN having the first standard diameter end or from the subset of stations producing a can having the second standard diameter end.

In another aspect, a beverage can is described designed to hold at least 20 oz. of beverage, comprising a can body having a diameter of at least 2.8 inches, and a neck portion, wherein the neck portion of the can body is formed by at least 15 necking operations to have a finished diameter designed to receive a 202 can end to close off the can body.

DETAILED DESCRIPTION OF PREFERRED EMBODIMENT

Figure 1:
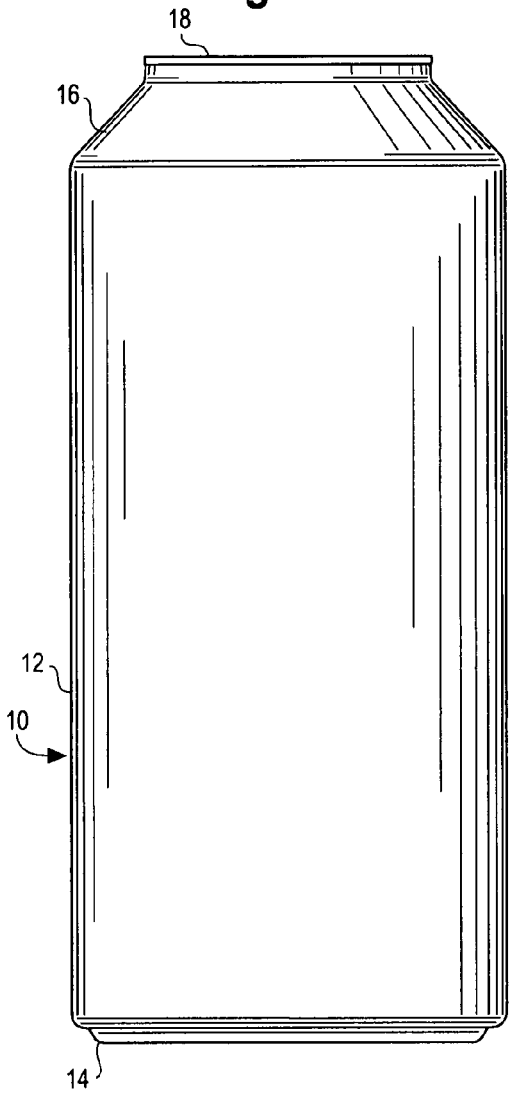
FIGS. 1-3 are side, perspective and top plan views of a can body having been necked to a first diameter to receive a first standard end.
Figure 2:
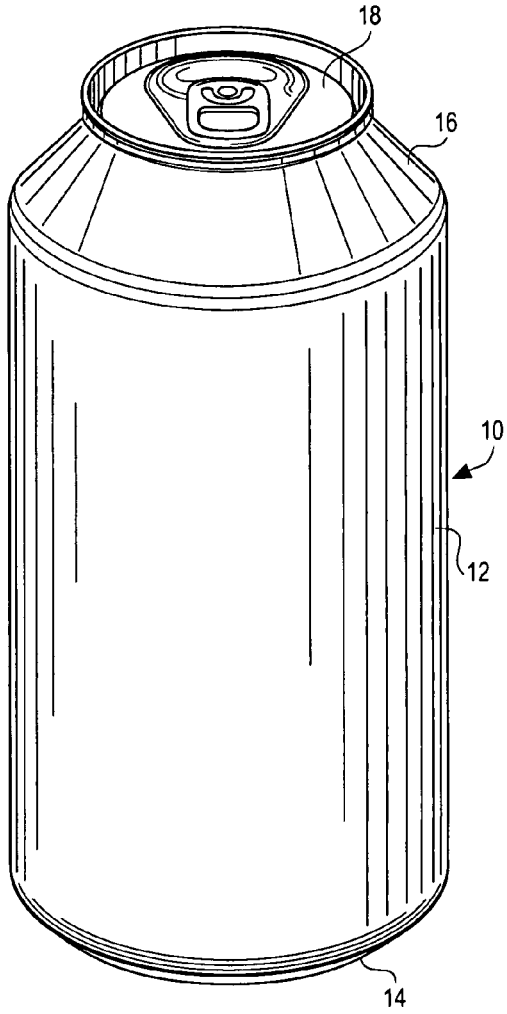
Figure 3:
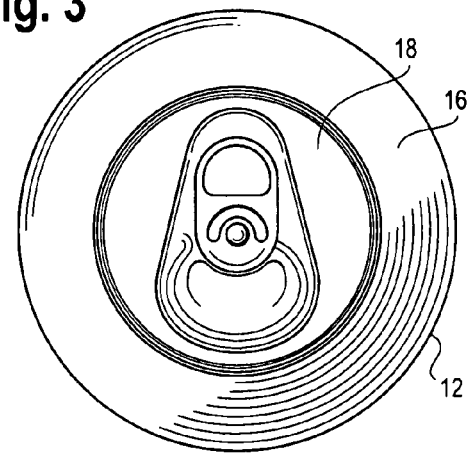

Referring now to the Figures, FIGS. 1-3 are side, perspective and top plan views of a can body 10. The can body 10 includes a side wall 12, a closed bottom 14, and a necked-in shoulder portion 16 which has been necked to a first diameter to receive a first standard end 18. The can body in this example is a beverage can containing at least 20 oz. of beverage, and having a diameter of 2.8 inches or greater. For example, the can body contains 24 oz. of beverage and has a diameter of about 2.87 inches or 3.0 inches. The shoulder portion 16 is necked to receive an 202 diameter end 18. The can body 10 is necked in a necking unit which includes N necking stations S1, S2, . . . SN, such as for example 20 or 25 of such stations, shown in FIG. 6A or 6C which will be described subsequently.

Figure 4:
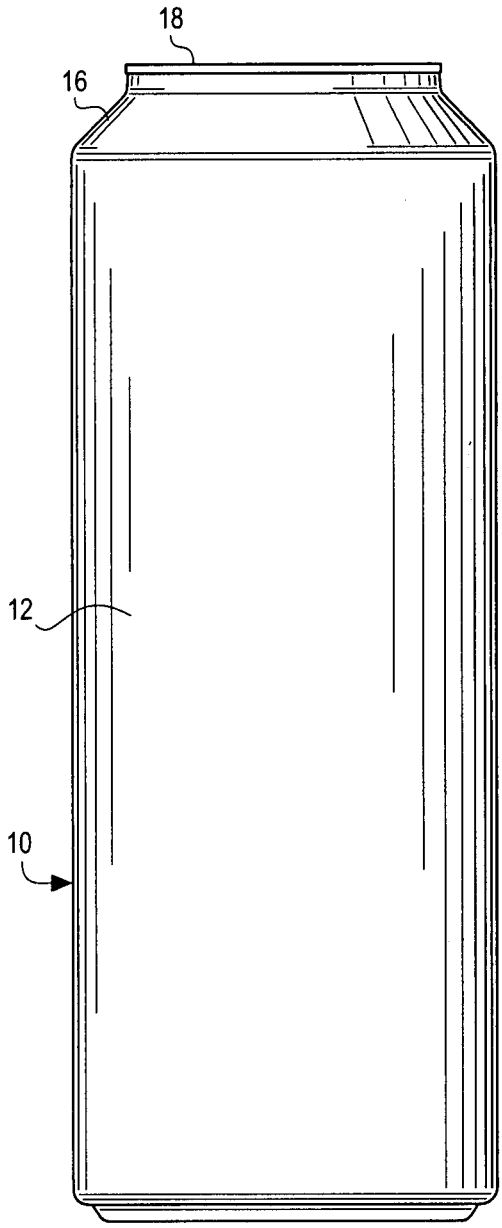
FIGS. 4 and 5 are side and perspective views of a can body having been necked to a second diameter to receive a second standard end. The end of FIGS. 4 and 5 is of a greater diameter than the end of FIGS. 1-3.
Figure 5:
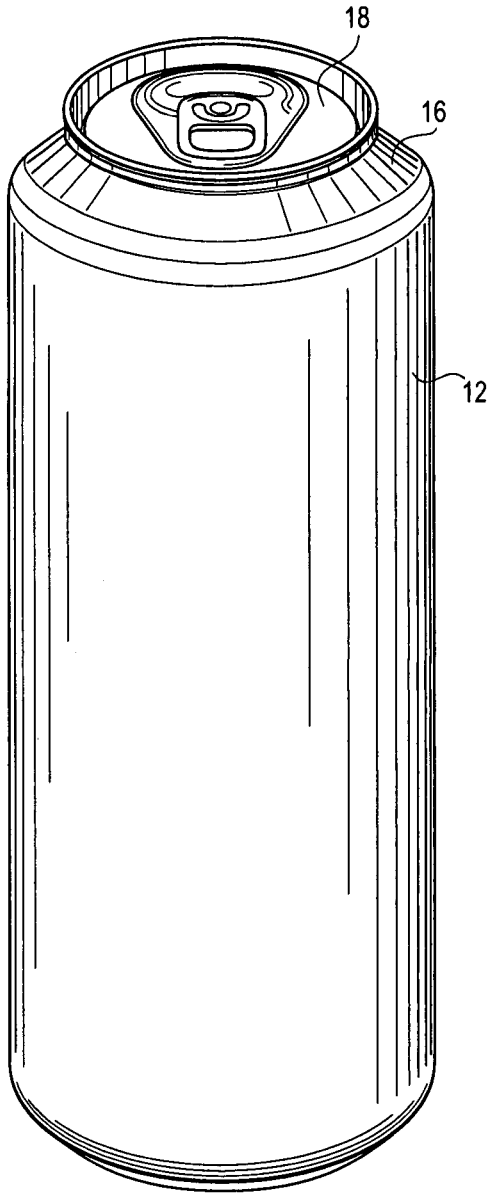

The necking stations are constructed and arranged such a subset of the stations provide a series of necking stations that will neck the same size can body down to a larger diameter to receive a second standard end, such as for example a 209 end or a 206. See FIGS. 4 and 5. The can body 10 includes a shoulder portion 16 which has less diameter reduction so as to receive a second standard end 18, for example a 209 end. A 209 end has a diameter which is 7/16 inch greater than the 202 end, hence the neck 16 of FIGS. 4 and 5 is shorter and has less diameter reduction as compared to the neck 16 of FIGS. 1 and 2. FIGS. 4 and 5 are not to scale and are intended to only represent the concept that the same can body can be necked down to a receive a second standard end. The term "standard" end is used to refer to an end diameter which is standard in the industry.

Figure 6A:
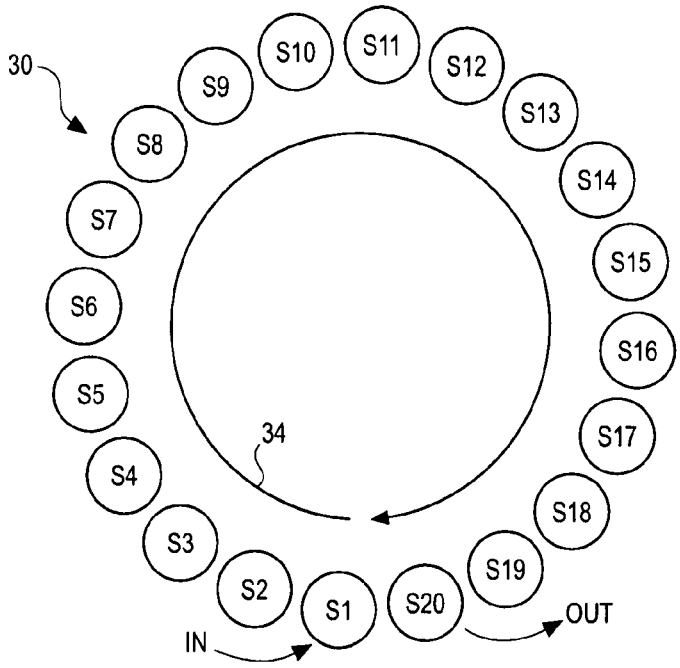
FIG. 6A is schematic illustration of a necking unit including twenty individual necking stations. The entire set of necking stations of FIG. 6A would produce the can body shown in FIGS. 1-3.

FIG. 6A is schematic illustration of a necking unit 30 which including twenty individual necking stations S1 to S20. The specifics of necking units, necking stations, and can transfer assemblies are known widely and described in the patent literature, are not important and can vary widely, and so the details are omitted in order to not obfuscate the present disclosure. Can bodies having a straight cylindrical side wall (see FIG. 7) enter the necking unit 30 at high speed one at a time at the station S1 in known fashion. The cans are transferred one at a time to the stations in the direction indicated by the arrow 34. Station S1 conducts a first necking operation and the can is transferred to station S2, where a second necking operation is performed. The can is then transferred to station S3 for a third necking operation. The can is eventually subject to a $20^{th}$ necking operation at station S20 and then transferred out of the necking unit 30 to downstream processing stations such as flanging station, the details of which are not important. The entire set of necking stations of FIG. 6A would produce the can body with the 202 diameter neck shown in FIGS. 1-3. While the necking unit 30 is shown constructed as a single unit with 20 modules or stations, the unit 30 can be divided into sub-units each with say 5 or 10 necking stations, such as four subunits of 5 stations each.

Figure 6B:
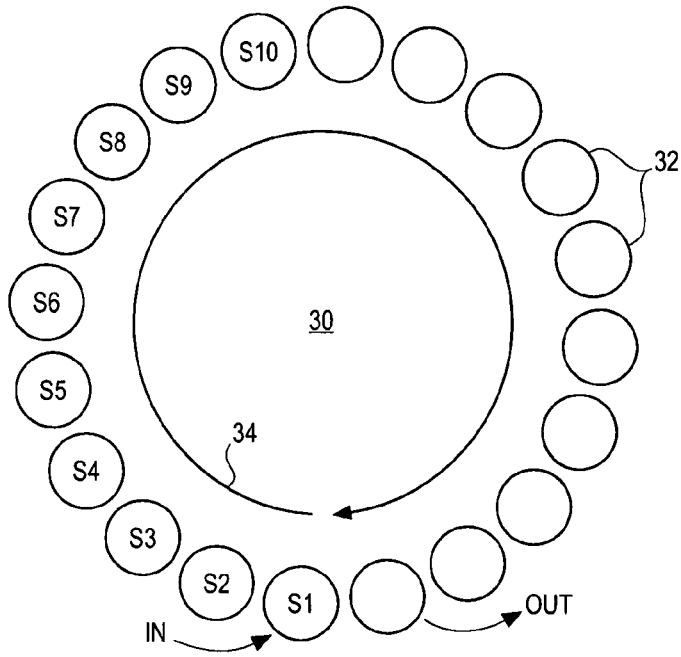
FIG. 6B is a schematic illustration of the necking unit of FIG. 6A, in which only a a subset of the stations S1 . . . S10 are operational to produce the can body of FIGS. 4 and 5. The extra ten necking stations S11 . . . S20 from FIG. 6A are either not used or rendered no-operational.

The necking stations of FIG. 6A are designed and constructed such that a subset of the necking stations will neck the can down to a second standard diameter to received a second standard end. Consider for example the can of FIGS. 1-5. Stations S1-S20 neck down to a 202 end (FIGS. 1-3). Stations S1-10 neck the same can body down to receive a 209 end (FIGS. 4, 5). FIG. 6B shows the arrangement of the tooling in the necking unit 30 to neck down to a 209 end, e.g., when the customer desires to use the same can body but a larger diameter end. Stations S1-S10 are operational and perform the same necking operations as in FIG. 6A. However, the necking tooling in stations S11-S10 is either removed or rendered inoperative (e.g., placed in the "up" or idle condition), which is indicated by the empty circles 32. No new tooling is required to make the 209 diameter cans. Rather, the subset of tooling S1 . . . S10 is used.

The diameter reduction D achieved for each of the necking stations $S_i$, $S_{i+1}$ . . . $S_j$ is defined approximately in accordance with the following relationship D=T/N, where T represents the total amount of necking to be performed on the beverage can by the set of N necking stations and N represents the number of necking stations. For example, T may 14/16 inches, N is 20 and so D is 0.04375 inches (14/320). The diameter reduction D for at least one of the necking stations in the series of necking stations $S_i$, $S_{i+1}$, . . . , $S_j$ is adjusted from D by an amount ±Δ. Consider the example of FIGS. 6A and 6B. The diameter rejection achieved by the $10^{th}$ necking station S10 is adjusted above or below this amount by a small amount Δ so that the $10^{th}$ station produces a can body diameter which produces the correct diameter to received the second standard end diameter.

In another variation, a second subset of the stations are designed to neck the can body down to a receive a third standard end, which has a diameter between that of the first end (e.g., 202) and the second standard end (209). For example, stations S1 . . . S15 are constructed and arranged such that after the $15^{th}$ station operates on the can body the can has been necked down to receive a 204 diameter end.

Figure 6C:
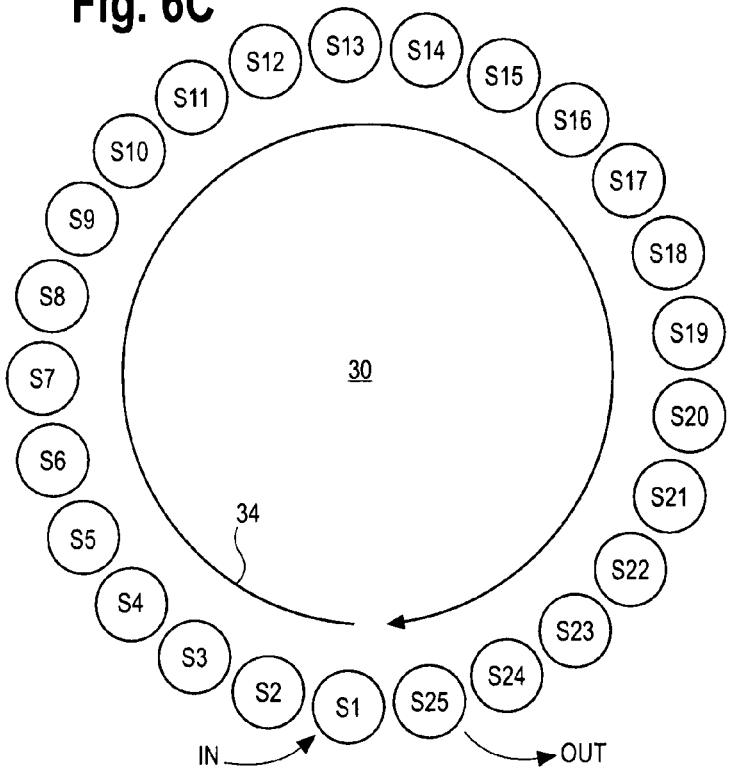
FIG. 6C is a schematic illustration of a necking unit including twenty five individual necking stations. The entire set of necking stations of FIG. 6C would produce the can body shown in FIGS. 1-3.

FIG. 6C is a schematic illustration of a necking unit 30 including twenty five individual necking stations S1 . . . S25. The entire set of necking stations of FIG. 6C produce the can body shown in FIGS. 1-3, designed to receive the smaller diameter standard end 18, e.g., a 202 diameter end.

Figure 6D:
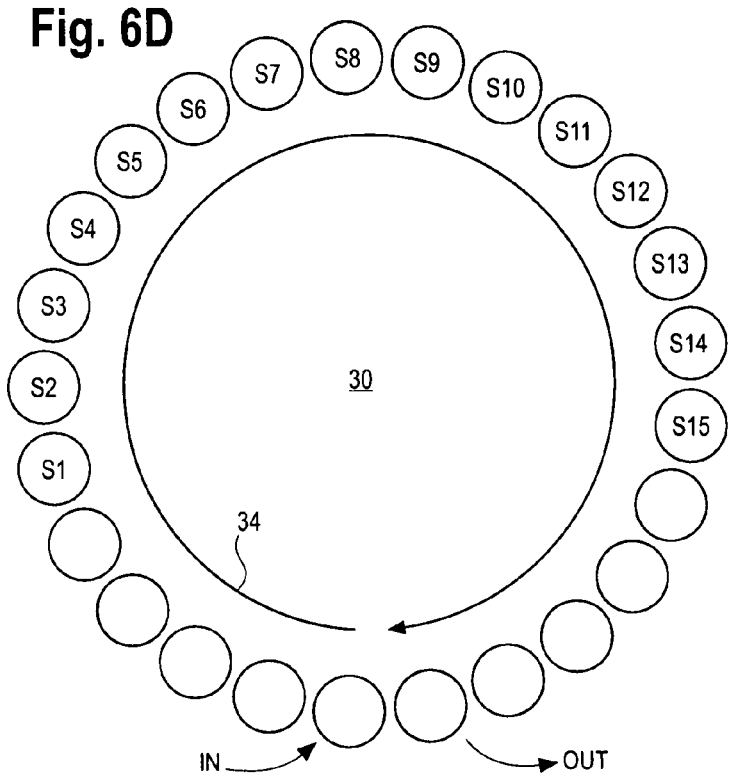
FIG. 6D is a schematic illustration of a necking unit in which a subset of 15 of the stations of FIG. 6C is used to neck a can down to receive a second standard diameter end. Note also in FIG. 6D that the tooling in the first necking station is shifted over five necking stations.

FIG. 6D is a schematic illustration of a necking unit 30 of FIG. 6C in which a subset of 15 of the stations of FIG. 6C is used to neck the same can body down to receive a second standard diameter end, e.g., the end of FIGS. 4 and 5. In this case, Stations S1 . . . S15 produce can body designed to receive a 206 diameter end, for example. In FIG. 6D the necking tooling of the stations S1 to S15 is shifted over five necking stations, so that when the cans enter the necking unit 30 the first five stations are inoperative or contain no necking tooling. The cans are transferred one at a time to the station S1, S2, S3 . . . S15 as shown in FIG. 6 where the 15 necking steps are performed to form a can body adapted to receive the 206 diameter end. After being necked at S15, the last five positions of the necking unit 30 either contain no tooling or the tooling is inoperative or in the "up" position.

Figure 6E:
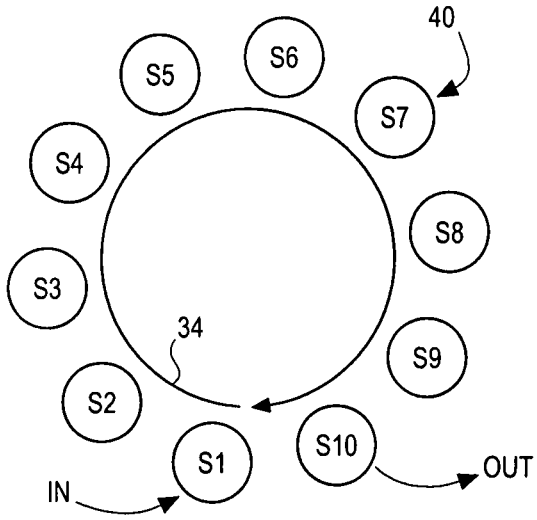
FIG. 6E shows another possible configuration of how the 10 stations selected from the set of FIG. 6A could be used in 10 station necking unit.

The subset of stations which are used to neck down to the second standard diameter end could be installed in a different necking unit with the number of stations matching the number of stations used to neck down to the second standard diameter end. For example, as shown in FIG. 6E, the 10 stations from FIG. 6 could be incorporated into a necking unit 40 which has 10 stations, and S1 . . . S10 installed in the necking unit 40 as shown.

Figure 7:
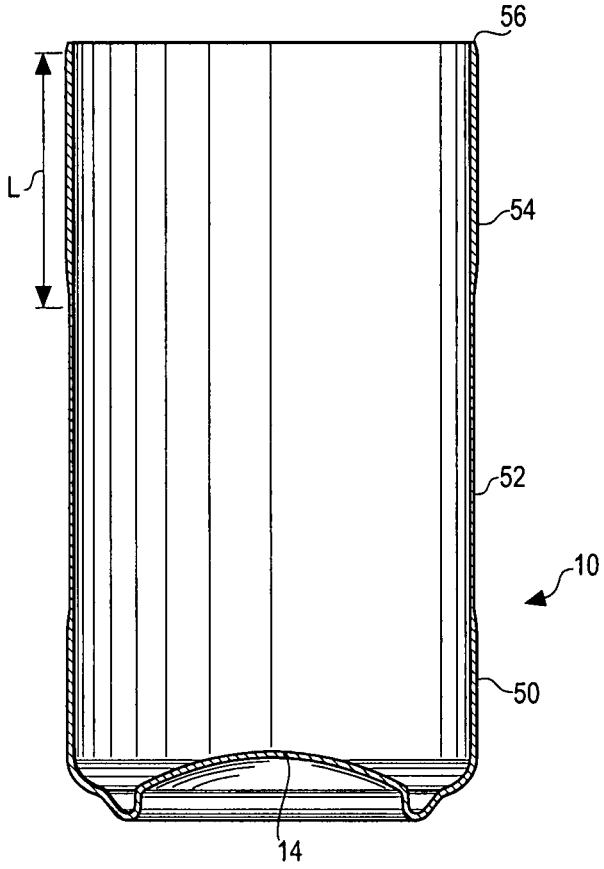
FIG. 7 is a cross-section of a can body showing the top wall and side wall features, with the thickness of the topwall greatly exaggerated for purposes of illustration.

As noted previously, to take a large diameter can (diameter greater than 2.8 inches) and neck it down to a small diameter end such as 202 or 204, the tooling in the can body maker is modified in accordance with another feature of this invention to provide a top wall of sufficient length. FIG. 7 shows a can body 10 having a closed bottom portion 14, a bottom wall portion 50 which tapers to a relatively thinner mid-wall portion 52 which tapers to a relatively thicker top wall portion 54 having an upper rim or cut edge 56. Whereas in the prior art the top wall for a 24 oz. can was on the order of 0.645 inches, the can bodies of this disclosure have a top wall length L of at least about 1.00 inches, and more preferably between 1.00 and 1.40 inches. The necking of the can is performed on the top wall portion 54. The thicknesses are greatly exaggerated in FIG. 7 and not to scale, and the relative length of the top wall, mid-wall and bottom wall are also not to scale.

Figure 8:
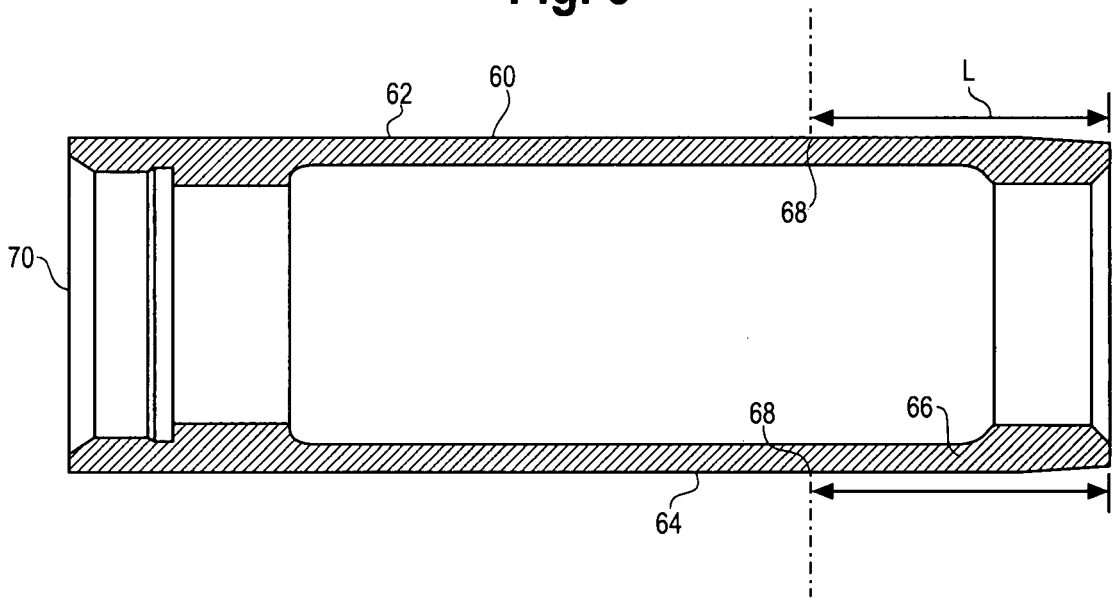
FIG. 8 is a cross sectional view of a punch sleeve used in a can body maker which is modified to provide a longer topwall length of at least about 1.00 inch to provide additional material in the top wall for the necking required to neck larger can bodies down to receive smaller standard ends such as 209 and 202 ends.

FIG. 8 is a cross sectional view of a punch sleeve 60 used in a can body maker which is modified to provide a longer top wall length L of at least about 1.00 inch to provide additional material in the top wall for the necking required to neck larger can bodies down to receive smaller standard ends such as 209 and 202 ends. The punch sleeve 60 includes a peripheral surface 62 including a lower portion 64 forming the bottom wall and mid-wall, an upper portion 66, and a transition point 68 where the lower portion 64 transitions to the upper portion 66. The upper portion 66 forms the top wall portion of the can body of FIG. 7. The punch sleeve 60 tapers slightly at transition point 68 such that the upper portion 66 has a smaller diameter than the lower portion 64. By moving the transition point 68 closer to the end 70 of the punch, the top wall length is lengthened to the desired amount, i.e., between about 1.00 and 1.40 inches. In one specific embodiment for necking a 24 oz. beverage can, L is equal to 1.175 inches.

Generalizing the foregoing examples, in one aspect of this disclosure a beverage can manufacturing apparatus has been described comprising a set of N necking stations $S_1$, $S_2$ . . . $S_N$ for progressively necking a beverage can body having a diameter greater than or equal to 2.8 inches to result in an open end designed to receive a first standard end (e.g., 202, 204, or 206), and wherein a subset of the necking stations $S_i \ldots S_j$, where $1 \leqq i<j<N$, progressively neck the beverage can body to result in an open end designed to receive a second standard end for the beverage can.

As demonstrated in FIGS. 6C and 6D, the middle of the necking stations (station $S_{(i+j)/2}$ is within 2 necking stations of the middle necking station or stations in the progression of necking stations $S_1, S_2, \ldots, S_N$.

In one embodiment, the first standard end comprises a 202 end and the second standard end comprises a 209 end. In another embodiment the first standard end comprises a 202 end and wherein the second standard end comprises a 206 end. In another embodiment, the first standard end comprises a 202 end and wherein the second standard end comprises a 204 end. In preferred embodiments, the beverage can comprises a can designed to hold at least 12 oz. of beverage. For example, the beverage can comprises a 20 oz or 24 oz. beverage can.

The number N of necking stations can vary. In preferred embodiments, N is greater than or equal to 20. In one specific embodiment, N is equal to 20 and wherein $S_i$ comprises either the $4^{th}$, $5^{th}$ or $6^{th}$ necking station. See for example FIG. 6D, wherein S1 to S15 are shifted over by 5 stations and the first and last 5 stations are rendered inoperative or have no tooling.

The flexible necking station arrangements of this disclosure are preferably implemented in a can manufacturing apparatus that includes a can body maker for forming the beverage can body having a punch sleeve (FIG. 8) and wherein the punch sleeve is designed such that the beverage can body has a top wall length L of at least about 1.00 inch, and in preferred embodiments L is between about 1.00 and 1.40 inches.

In a specific embodiment, N is at least about 20 and wherein the diameter reduction performed by the N necking stations is approximately between 13/16 inches and 1.40 inches, inclusive. In such an arrangement the beverage can is designed to hold greater than 12 oz of beverage. In one particular embodiment the beverage can is designed to hold at least 20 oz. of beverage, the set of necking stations $S_1 \ldots S_N$ neck the beverage can body down to a receive a 202 end and wherein the station $S_j$ necks the can down to receive a 209 end. In another embodiment the beverage can is designed to hold at least 20 oz. of beverage, the set of necking stations $S_1 \ldots S_N$ neck the beverage can body down to a receive a 202 end.

Still further aspects include a beverage can made in accordance with any of the beverage can manufacturing apparatus described herein.

In still another aspect, a beverage can is described which is designed to hold at least 20 oz. of beverage, comprising a can body having a diameter of at least 2.8 inches, and a neck portion, wherein the neck portion of the can body is formed by at least 15 necking operations to have a finished diameter designed to receive a 202 can end to close off the can body.

While a number of exemplary aspects and embodiments have been discussed above, those of skill in the art will recognize that certain modifications, permutations, additions and sub-combinations thereof are also present in the disclosure. It is therefore intended that the following appended claims and claims hereafter introduced are interpreted to include all such modifications, permutations, additions and sub-combinations as are within their true spirit and scope.

We claim:

1. Beverage can manufacturing apparatus, comprising in combination a) a set of necking stations $S_1, S_2 \ldots S_N$ for progressively and smoothly necking a beverage can body having a diameter greater than or equal to 2.8 inches to result in an open end designed to receive a first standard end, where N is an integer greater than or equal to 20, and wherein a subset of the necking stations $S_i \ldots S_j$, where $1<i<j<N$, progressively neck the beverage can body to result in an open end designed to receive a second standard end for the beverage can; and b) a can body maker for forming the beverage can body having a punch sleeve and wherein the punch sleeve is designed with a peripheral surface having a lower portion forming a bottom wall and mid-wall of the beverage can body, a transition point and an upper portion, the transition point being where the lower portion transitions to the upper portion, the upper portion forming a top wall of the can body, the punch sleeve tapering at the transition portion such that the upper portion has a smaller diameter than the lower portion to thereby provide the beverage can body with a relatively thick topwall of sufficient length L of at least about 1.0 inch such that the required amount of necking of the beverage can body to an open end designed to receive either the first or second standard end can be performed without wrinkling or other problems in the can body.

2. The beverage can manufacturing apparatus of claim 1, wherein the punch sleeve is designed such that the beverage can body has a topwall length of between 1.00 and 1.40 inches.

3. The beverage can manufacturing apparatus of claim 2, wherein the beverage can is designed to hold at least 20 oz. of beverage, the set of necking stations $S_1 \ldots S_N$ neck the beverage can body down to receive a 202 end and wherein the station $S_j$ necks the can down to receive a 209 end.

4. The beverage can manufacturing apparatus of claim 2, wherein the beverage can is designed to hold at least 20 oz. of beverage, the set of necking stations $S_1 \ldots S_N$ neck the beverage can body down to receive a 202 end.

5. The beverage can manufacturing apparatus of claim 1, wherein the diameter reduction performed by the N necking stations is approximately between 13/16 inches and 1.40 inches, inclusive.

6. The beverage can manufacturing apparatus of claim 1, wherein the beverage can is designed to hold greater than 12 oz of beverage.

* * * * *